US007434508B2

(12) United States Patent
Corcoran et al.

(10) Patent No.: US 7,434,508 B2
(45) Date of Patent: Oct. 14, 2008

(54) DIE PRESS WITH DUAL CAM

(75) Inventors: Kevin L. Corcoran, Mission Viejo, CA (US); Carl Von Hirsch, Temecula, CA (US); David L. Hughes, Jr., Rancho Santa Margarita, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 226 days.

(21) Appl. No.: 11/198,624

(22) Filed: Aug. 5, 2005

(65) Prior Publication Data

US 2006/0032385 A1 Feb. 16, 2006

Related U.S. Application Data

(62) Division of application No. 10/155,706, filed on May 22, 2002, now Pat. No. 6,945,166.

(60) Provisional application No. 60/292,802, filed on May 22, 2001.

(51) Int. Cl.
*B30B 1/12* (2006.01)
*B30B 1/14* (2006.01)

(52) U.S. Cl. ..... 100/291; 100/229 R; 100/293

(58) Field of Classification Search ..... 100/229 R, 100/280, 281, 283, 293, 233, 234, 236; 83/628, 83/623

See application file for complete search history.

(56) References Cited

U.S. PATENT DOCUMENTS

| | | | | |
|---|---|---|---|---|
| 1,453,405 | A | | 5/1923 | Platt |
| 1,658,823 | A | | 2/1928 | Willard |
| 2,112,011 | A | | 3/1938 | Byerlein |
| 2,260,183 | A | | 10/1941 | Leslie |
| 2,619,173 | A | | 11/1952 | Crain |
| 2,641,781 | A | | 8/1953 | Haskell |
| 3,094,091 | A | | 6/1963 | Peccarill |
| D211,608 | S | | 7/1968 | Gray |
| 3,935,811 | A | | 2/1976 | Lenz et al. |
| 3,986,447 | A | | 10/1976 | Zimmer |
| D257,777 | S | | 1/1981 | Eichenberg et al. |
| D296,565 | S | | 7/1988 | Eichenberg et al. |
| 5,172,622 | A | | 12/1992 | Sabin |
| 5,255,587 | A | | 10/1993 | Eichenberg et al. |
| D341,842 | S | | 11/1993 | Eichenberg et al. |
| D359,967 | S | | 7/1995 | Eichenberg et al. |
| 5,435,883 | A | * | 7/1995 | Myers ..... 156/583.9 |
| 5,463,941 | A | * | 11/1995 | Gibson ..... 99/495 |
| 5,628,226 | A | | 5/1997 | Weissman |
| 5,775,213 | A | | 7/1998 | Hyde |
| 5,778,748 | A | | 7/1998 | Beijen |
| D400,914 | S | | 11/1998 | Corcoran et al. |

(Continued)

*Primary Examiner*—Shelley Self
(74) *Attorney, Agent, or Firm*—Townsend and Townsend and Crew

(57) ABSTRACT

Disclosed is a die press with a base, at least two cam members spaced from the base, an upper platen located between the base and the two cam members to define a space for a die, the upper platen being generally parallel to the base, the upper platen also being attached to the two cam members so that when the two cam members are actuated, the upper platen is moveable relative to the base, and a linkage connecting the two cam members so that the two cam members move in unison relative to each other when actuated.

6 Claims, 8 Drawing Sheets

U.S. PATENT DOCUMENTS 6,058,834 A * 5/2000 Beckwith ..... 100/99
D472,564 S 4/2003 Corcoran et al.
6,619,195 B2 9/2003 Corcoran et al.

* cited by examiner

DIE PRESS WITH DUAL CAM

CROSS-REFERENCES TO RELATED APPLICATIONS

This application is a divisional of U.S. application Ser. No. 10/155,706, filed May 22, 2002, now U.S. Pat. No. 6,945,166, which claims the benefit of U.S. Application Ser. No. 60/292,802 filed on May 22, 2001, each of which is hereby fully incorporated by reference herein as though set forth in full.

FIELD OF THE INVENTION

The present invention relates to sheet cutting presses and, more particularly, a sheet cutting press that may be used for precise cuts.

BACKGROUND OF THE INVENTION

Dies and sheet cutting presses are used to cut various patterns out of sheet materials. The presses are designed to apply uniform pressure to a platen and die to cut through a sheet or a plurality of sheets simultaneously. Also an amount of uniform pressure may be applied to the die to force a portion of the steel blade of the die through only a portion of a sheet or combination of sheets, which is referred to as a "kiss-cut." For example, a first sheet or laminate with an adhesive backing sheet may be used with the die so as to cut through the first sheet and so that the laminate sheet may be separated from the adhesive backing sheet. In these types of cutting applications described, there is a need for a die press that provides uniform pressure to the platen and die.

SUMMARY OF THE INVENTION

Disclosed is a die press, comprising a base, at least two opposing supports extending from the base, at least two cam members that are supported by the opposing supports, a handle extending from at least one of the cam members, an upper platen positioned between bearings and the base and which is pivotally connected to the cam members, and a linkage connecting the two cam members. The linkage allows the cam members to move in unison in relation to each other.

In another aspect of the invention, disclosed is a die press, comprising a base, an upper platen opposite of the base, means for moving the upper platen toward the base by rotating at least two cam members, and means for rotating the cam members at the same time.

In another aspect of the invention, disclosed is a method of actuating a die press, comprising a step for rotating at least two cam members generally simultaneously and a step for applying force to an upper platen to move the upper platen toward a base of the die press.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE INVENTION

A single cam die is disclosed in commonly owned U.S. Pat. No. 5,255,587, which is incorporated by reference in its entirety into this application.

Figure 1:
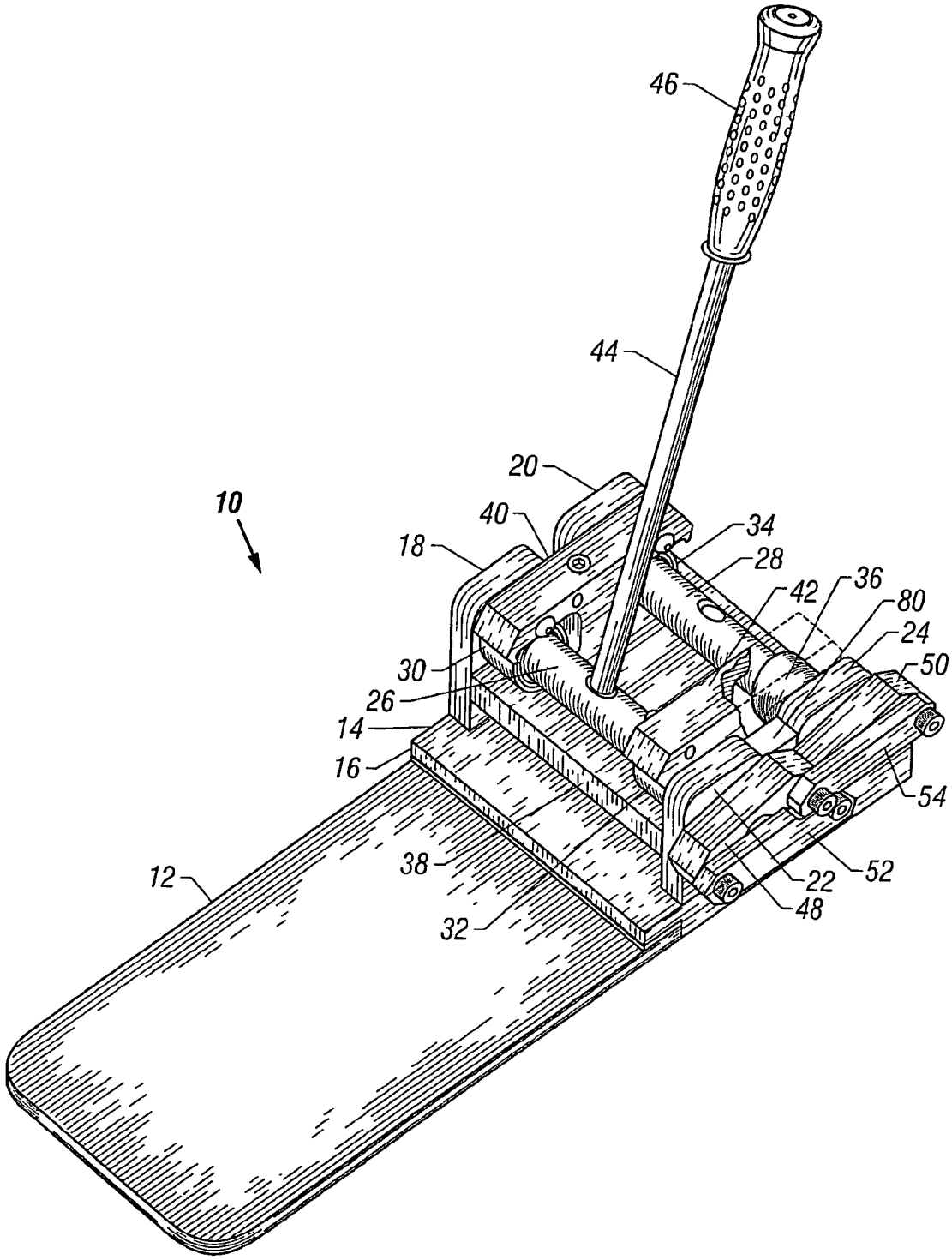
FIG. 1 is a front perspective view of the die press according to the present invention.

A die press 10 according to the present invention is shown in FIG. 1. The die press 10 includes a base 12 with a lower platen 14 that is generally parallel and adjacent to the base 12, defining a step 16. The step 16 provides a working area for the operator's fingers and hands so that dies may be placed into and out of the working area defined by a die space in between the upper and lower platens. In the alternative, the base 12 could also function as the lower platen if a step area was not required or desired.

As shown in FIG. 1, a first support 18, a second support 20, a third support 22, and a fourth support 24, all extend from the base 12 and the lower platen 14. The first support 18 opposes the third support 22, and the second support 20 opposes the fourth support 24. In the alternative, the first and second supports 18 and 20 could be combined into one support and the third and fourth supports 22 and 24 may be combined into a single support as long as space is provided for the guide blocks 78 and 80, which will be further described in more detail below. The supports 18 and 22 support a first cam member 26 and the supports 20 and 24 support a second cam member 28. The cam members 26 and 28 are generally parallel in relation to each other and the upper platen 38 is positioned between the cam members and the lower platen 16. The upper platen 38 is spaced from and is moveable relative to the lower platen 14. A first bearing 30 is located approximate to one end of the first cam member 26, and a second bearing, 32 is located approximate to the opposite end of the first cam member 26. Likewise, a third bearing 34 is located at an approximate end of the second cam member 28, and a fourth bearing 36 is located at the opposite approximate end of the second cam member 28. Positioned between the bearings and the lower platen 14 is the upper platen 38. The upper platen 38 must be connected to the cam members so that when the cam members are actuated, the upper platen is moveable in relation to the lower platen. One way of connecting the upper platen to the cam members is by providing an attachment to the upper platen which encompasses the bearings so that both upward pressure and downward pressure may be applied to the upper platen, which moves the upper platen accordingly. In this embodiment, a first bracket 40 is connected to the upper platen 38 so as to encompass a portion of the first bearing 30 and the third bearing 34. Likewise, a second bracket 42 extends from the upper platen 38 to encompass a portion of the second bearing 32 and the fourth bearing 36. As further explained below, that brackets 40 and 42 cooperate with the first and second cam members 26 and 28, so that when the cam members are rotated, the first and second brackets 40 and 42 are lowered, and likewise the upper platen 38 is lowered against a die positioned between the upper and lower platens in an area defined as the die space or die working space. When the first and second cam members 26 and 28 are rotated even further, uniform pressure is applied to the upper platen 38 via the cam members and the bearings 30, 32, 34, and 36. The first cam member 26 is actuated or rotated by use of a handle 44 extending from the first cam member 26, and the handle 44 has a grip 46 located at the end of the handle 44. In alternative embodiments, the handle may extend from the second cam member, or as explained below, may extend from the linkage. Further, as will be explained below, the second cam member 28 is rotated at the same time as the first cam member 26 by use of a linkage system. The term linkage used herein generally refers to the linkage system or assembly as well as the individual links.

Figure 2A:
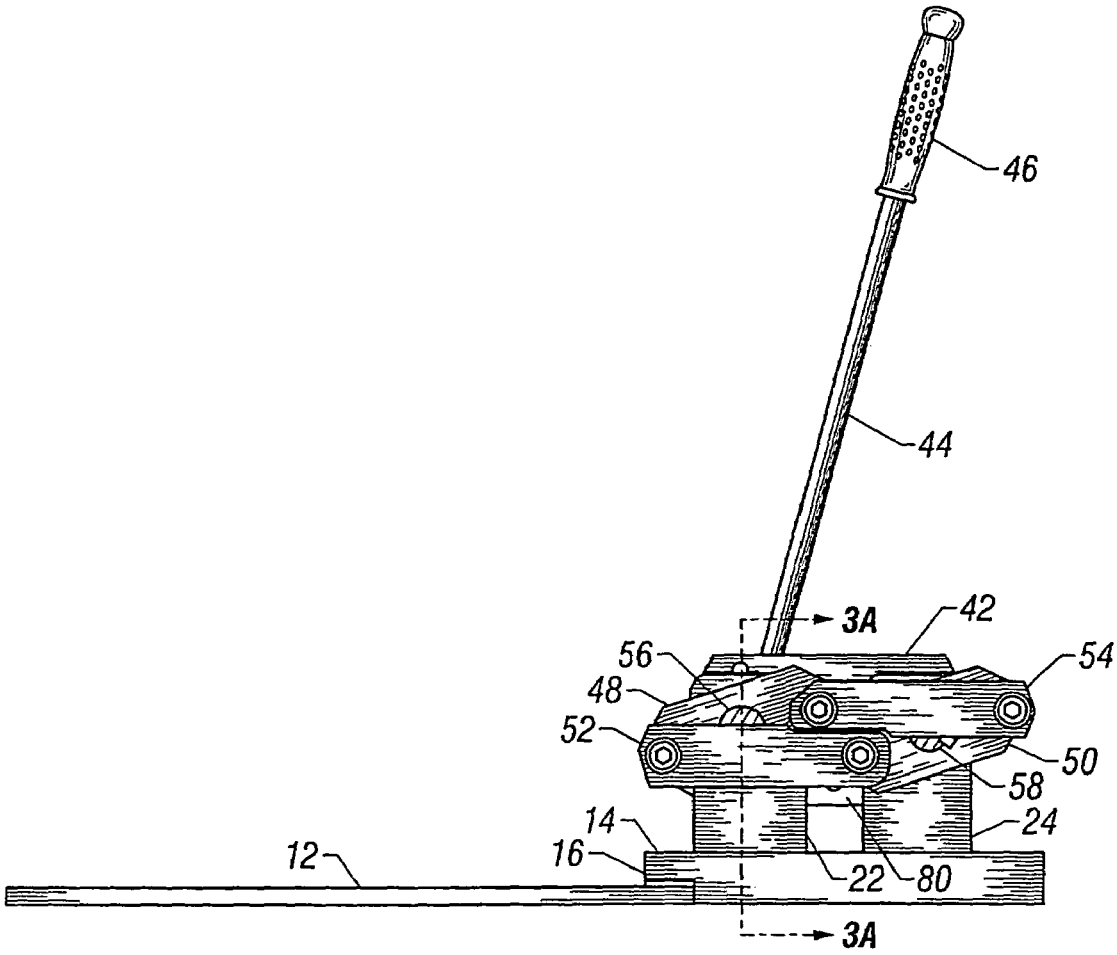
FIG. 2A through 2C are side elevational views of a die press according to the present invention.
Figure 2B:
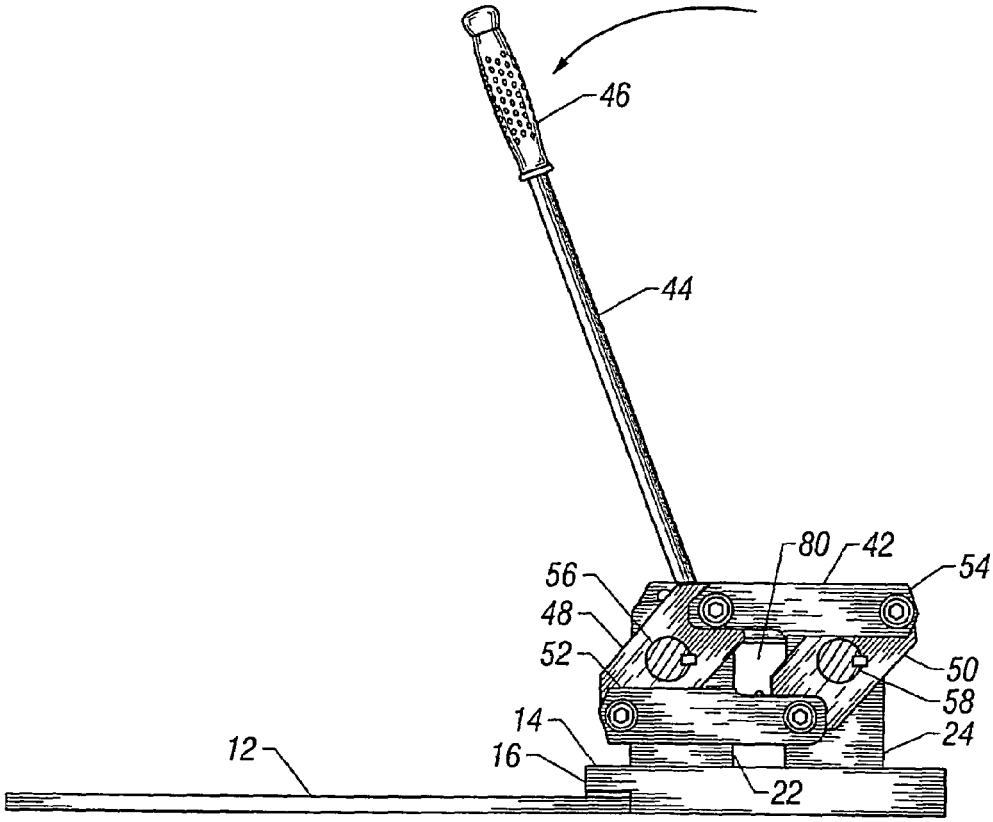
Figure 2C:
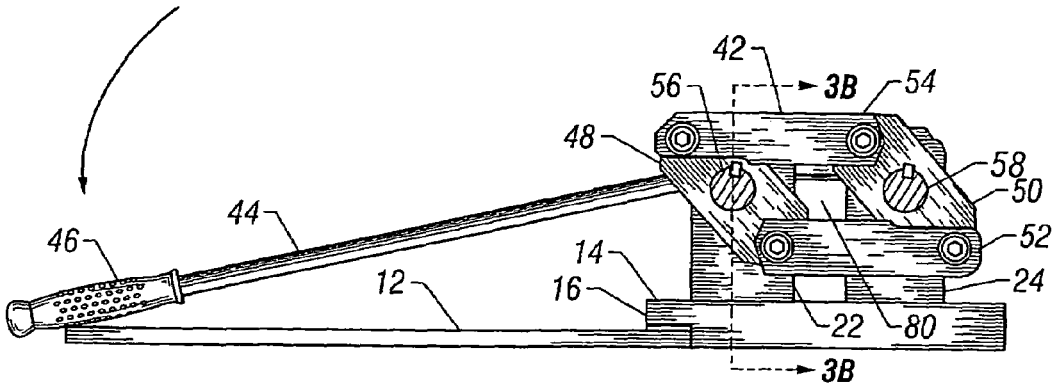

In general terms, when the cam members are actuated, they move in unison so as to apply uniform pressure to the upper platen. Therefore, the cam members move simultaneously when actuated. Activation is used as a general term herein, and refers to when the cam members are rotated by whatever means, such as a handle, electronic activation, gears, or the like. The linkage system includes a first lever 48, which is connected to the first cam member 26 by a third shaft end 56. Likewise, a second lever 50 is attached to the second cam member 28 by a corresponding fourth shaft end 58. A key and keyway may be used to secure the levers 40 and 50 to the shaft ends. The first cam member 26 and the corresponding first lever 48 are linked to the second cam member 28 and the second lever 50 by use of a first linkage 52 and a second linkage 54. The linkages 52 and 54 are secured to the first and second levers 48 and 50; however, they are free to pivot in relation to the first and second levers 48 and 50, as is illustrated in FIGS. 2A, 2B, and 2C. As will be further explained below, any linkage system or means for connecting or timing the cam members relative to each other so that they move in unison and apply uniform pressure to the top platen would achieve the intent of the present invention.

The die press according to the present invention is shown in an opened position in FIG. 2A, with the handle 44 at rest in an up position. FIG. 2B shows a force being applied to the handle 44 and illustrates the die press in a middle position. FIG. 2C illustrates the die press in a closed position with the handle 44 at rest in a down position. FIGS. 2A, 2B, and 2C illustrate the actuation, movement and relationship of the cam members 26 and 28, the shaft ends 56 and 58, the levers 48 and 50, and the linkages 52 and 54.

Figure 5:
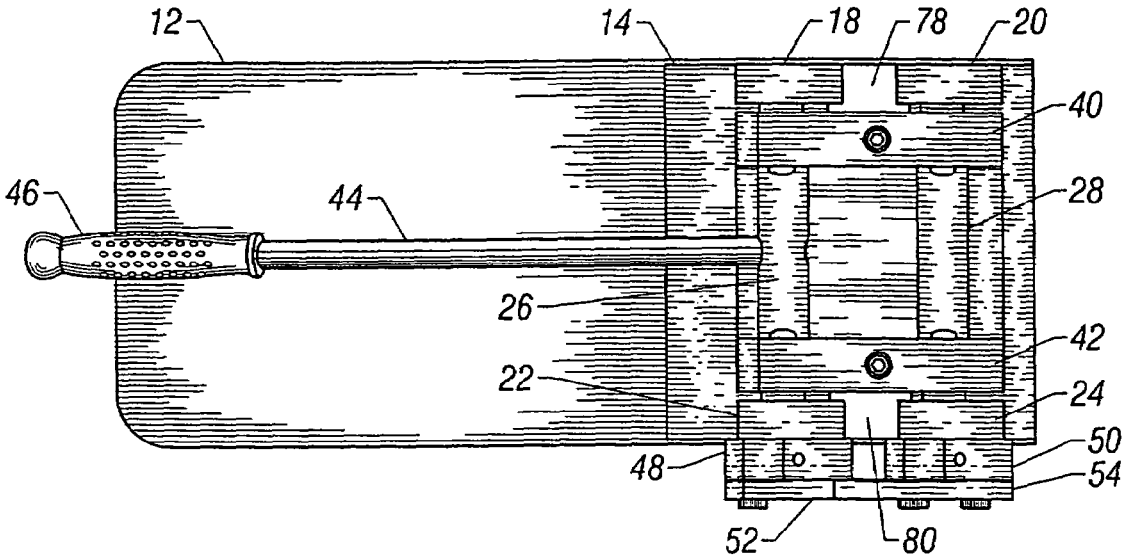
FIG. 5 is a top elevational view of the die press according to the present invention.

In the first embodiment, a first nylon guide block 78 is sandwiched in between the upper platen 38 and the first bracket 40. The nylon guide block 78 further extends into the space between the first support 18 and the second support 20. Likewise, a second nylon guide block 80 is positioned on the opposite side and is sandwiched between the upper platen 38 and the second bracket 42 and extends into the open space located in between the third support 22 and the fourth support 24. The nylon guide blocks 78 and 80 help to keep the upper platen 38 parallel to the lower platen 14 as it travels from the up position to the down position As best shown in FIG. 5, the nylon blocks 78 and 80 are "T" shaped so that they travel parallel to the respective supports 18, 20, 22, and 24.

Figure 3A:
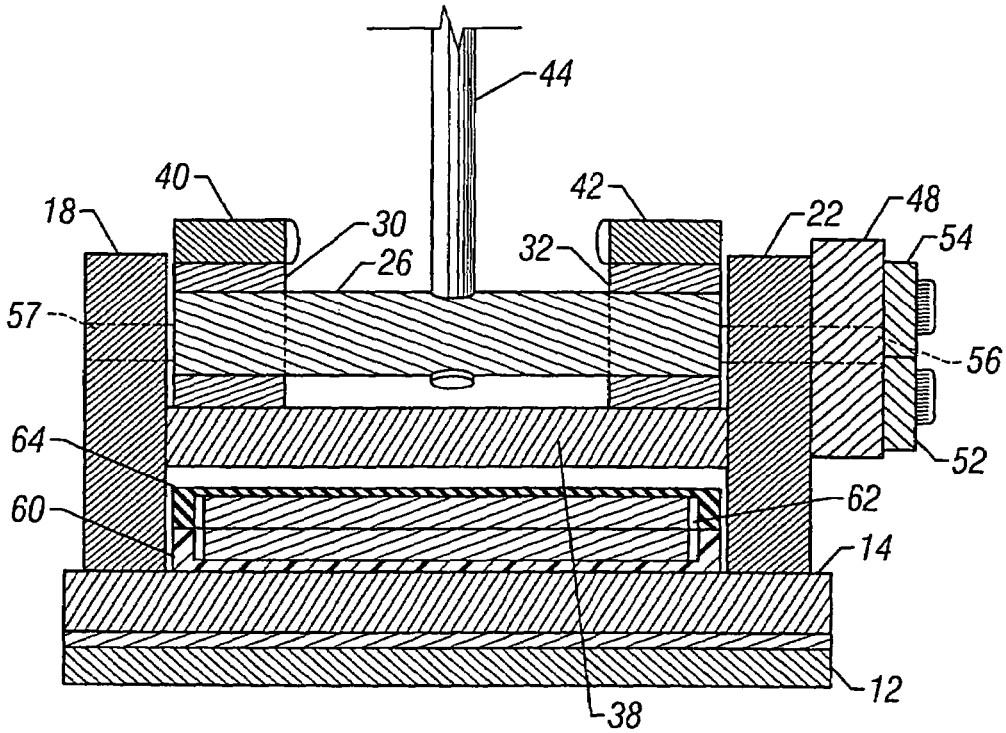
FIG. 3A is a front elevational view taken from line 3A-3A of FIG. 2A.
Figure 3B:
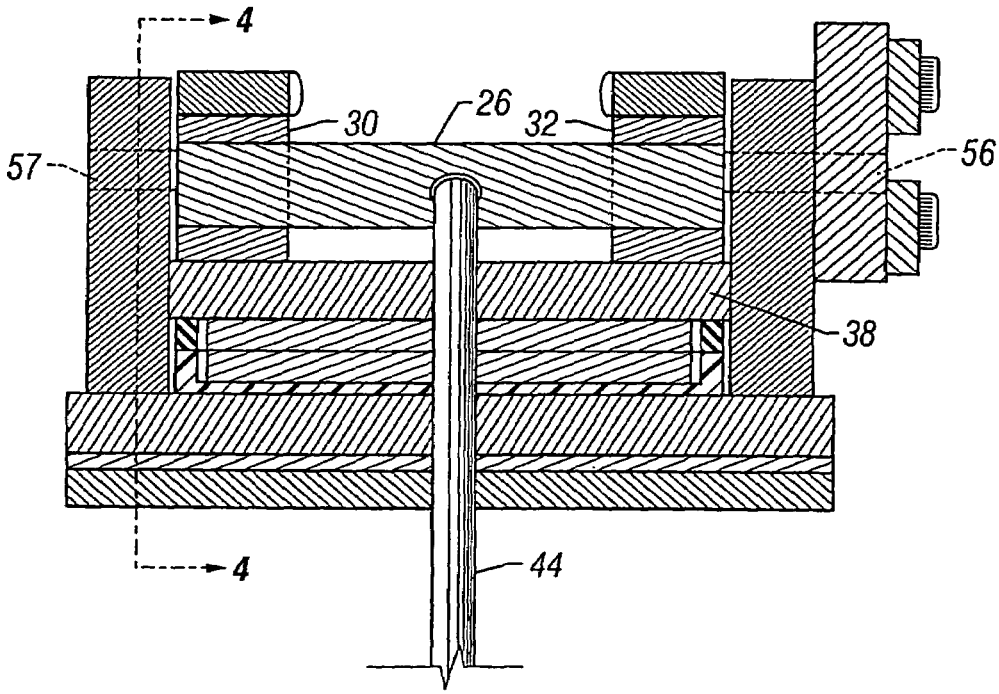
FIG. 3B is a front elevational view taken from line 3B-3B of FIG. 2C.

FIGS. 3A and 3B illustrate how the die press cooperates with a die located between the upper and lower platens. The die includes a die base 60, which may be made of plywood, plastic, or other suitable material. A steel rule blade 62 extends from the die base 60 and has a sharp edge around its distal edge. A rubber neoprene material 64 is attached to the die base 60 so as to protect the sharp edge of the steel rule blade 62. The die is positioned on the lower platen 14, and a sheet or plurality of sheets of paper or other materials, such as laminates, that are to be cut are positioned between one of the platens and the rubber material 64. FIG. 3A illustrates the handle 44 in the up position with the upper platen 38 being spaced from the die. FIG. 3B illustrates handle 44 in a down position, wherein a uniform force is applied to the upper platen 38 via the cam members and bearings to the die to cut a shape out of the sheet material that is positioned between the die and the appropriate platen. FIG. 3B illustrates the forces applied to the upper platen 38 being transferred from the cam members 26 and 28 via the bearings 30, 32, 34, and 36. This is further illustrated in FIG. 7 where it is shown that forces 30F, 32F, 34F, and 36F are transferred to the upper platen 38 via the corresponding bearings, 30,32,34, and 36. This arrangement allows for an even distribution of the forces through the upper platen 38 to the die.

Figure 3C:
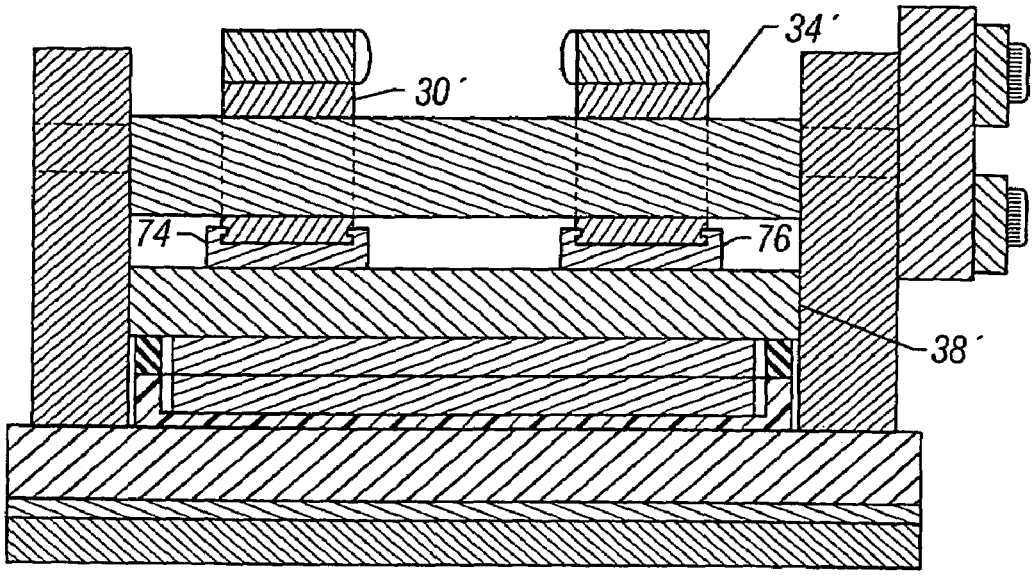
FIG. 3C is a view similar to FIG. 3A but showing an alternative embodiment.

An alternative embodiment is shown in FIG. 3C and described in commonly owned U.S. Pat. No. 5,255,587. The elements are generally the same as shown in FIG. 3B except that a plurality of corresponding shoes or bearing mounts are located between each bearing and the upper platen. For example, as shown in FIG. 3C, a first shoe 74 is located between a first bearing 30', and a second shoe 76 is located between the upper platen 38' and the third bearing 34'. The bearing mounts distribute the forces from the bearings to the upper platen.

Figure 4:
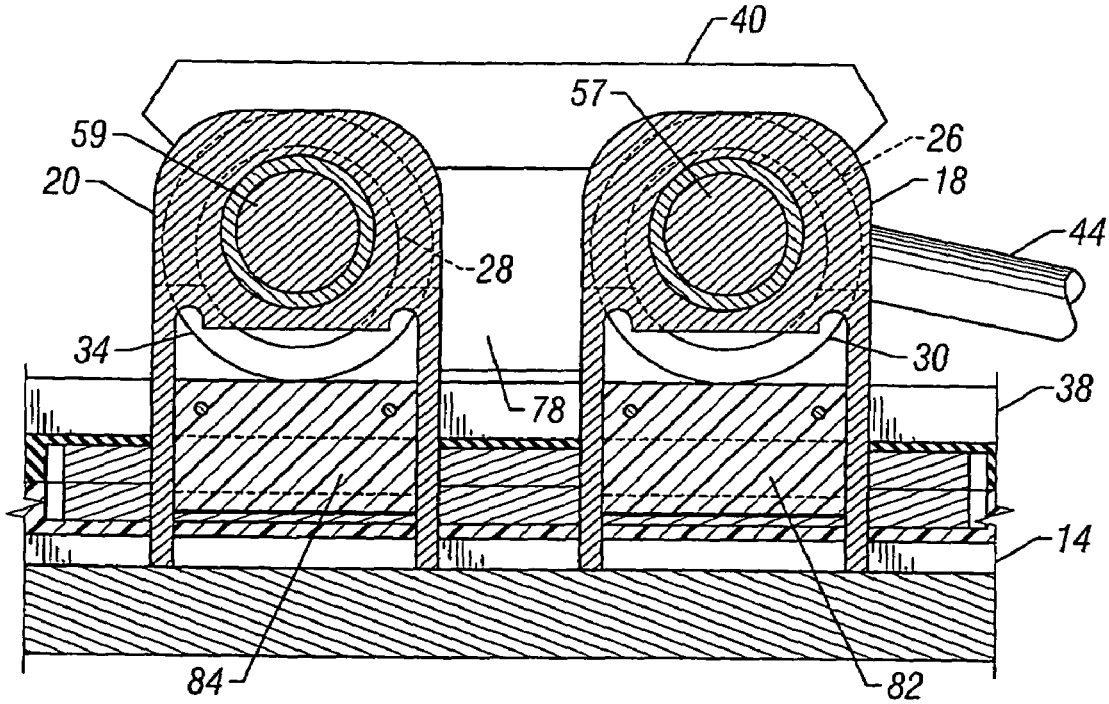
FIG. 4 is a side cross-sectional view taken from line 4-4 from FIG. 38.

As shown in FIG. 4, a first shaft end 57 is shown extending through first support 18. Likewise, a second shaft end 59 is shown extending through second support 20. It is further illustrated that the diameter of first cam member 26 is offset from the diameter of the first and third shaft ends 57 and 56 defining the cam member.

Likewise, the diameter of the second cam member 28 is shown offset from the second shaft end 59 and the fourth shaft end 58 defining another cam member. Therefore, when the lever 44 is in the down position, the cam members apply force to the upper platen 38 via the corresponding bearings or bearing mounts to apply force to the die, and a cutting action is completed through a sheet or a plurality of sheets of material.

FIG. 4 further illustrates that the first nylon guide block 78 works in cooperation with additional support guide blocks 82 and 84 which travel within recesses located within each support member 18, 20, 22, and 24. The support guide blocks 82 and 84 are attached to the upper platen 38. The opposing support members 22 and 24 house support guide blocks on the opposing ends.

FIG. 5 illustrates the top view of the die press according to the present invention and further illustrates the connection between the cam members 26 and 28, the levers 48 and 50, and the linkages 52 and 54.

Figure 6:
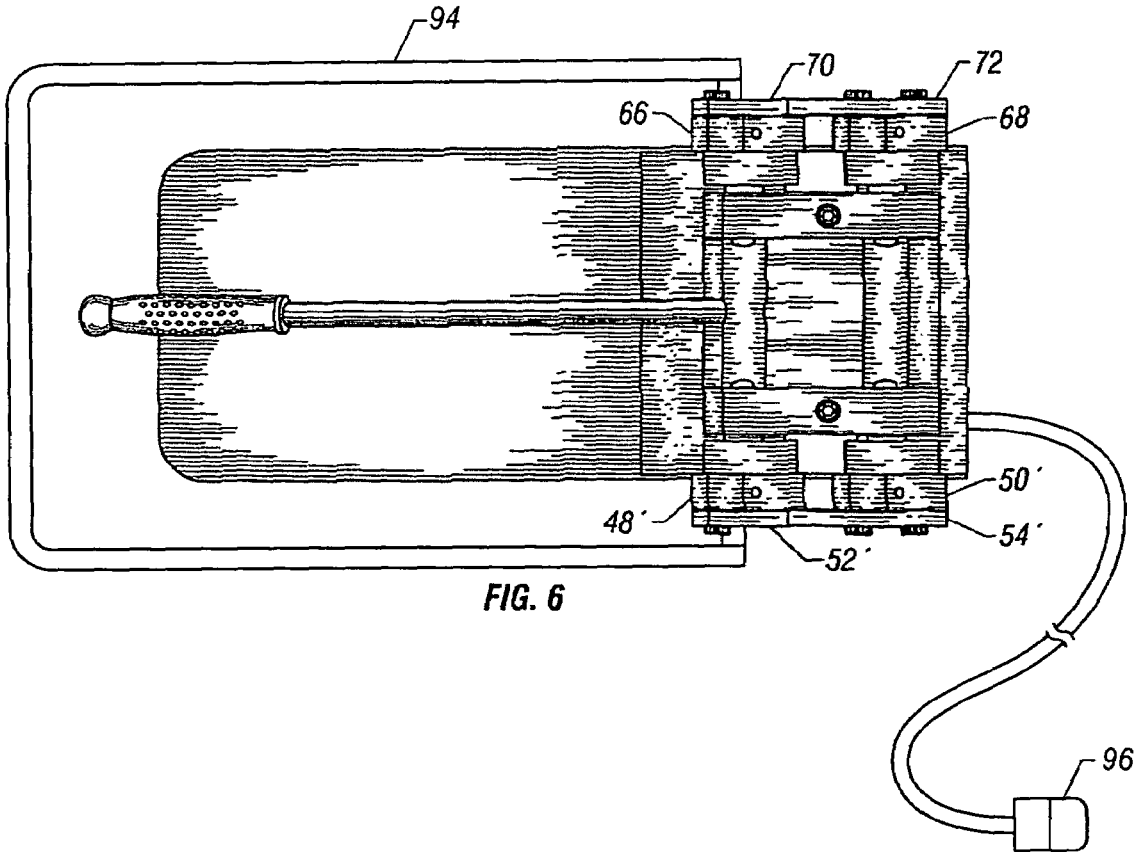
FIG. 6 is a top elevational view of an alternative embodiment according to the present invention.

An alternative embodiment is illustrated in FIG. 6, wherein the third lever 66 and a fourth lever 68 are both attached to the corresponding shaft ends with the appropriate linkages 70 and 72 connecting the levers 66 and 68. This embodiment provides further control of the movement of the cam members 26 and 28 so that uniform pressure may be applied to the upper platen. A "U" shaped handle 94 is shown which connects to linkages 70 and 52'. Also shown is a foot pedal 96 which may be used to actuate the die press automatically.

And yet in another embodiment, the handle may extend from one of the cam members, as will be further described below. In addition, the handle may be 'U' shaped so that the handle extends from the first linkage 52 and 54 to the second linkage 70 and 72. This provides further control of the movement of the cam members so that uniform pressure may be applied to the upper platen.

Figure 7:
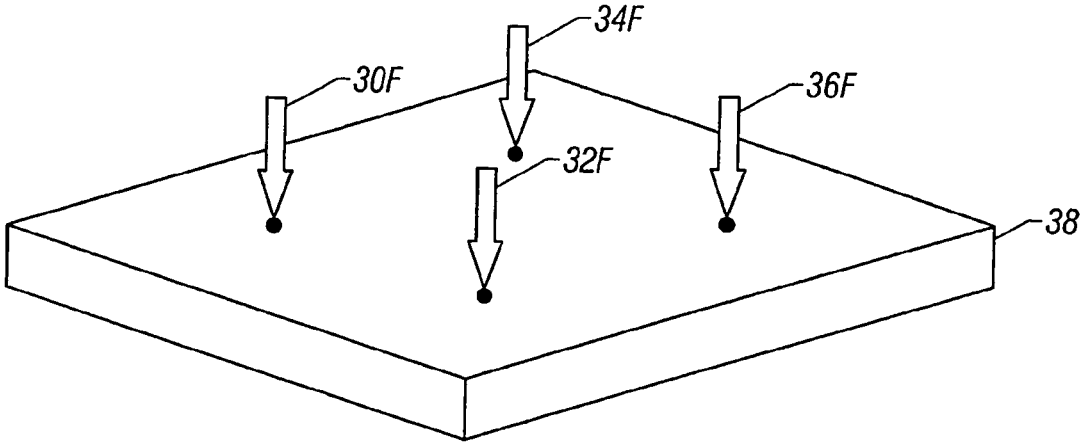
FIG. 7 is a schematic representation of forces applied to an upper platen by four bearings supported by two cam members according to the present invention.

FIG. 7 is a schematic representation of the uniform pressure being applied to the upper platen 38. The forces shown 30F, 32F, 34F and 36F represent the forces distributed from the cam members, bearings, and bearing mounts, if applicable, to the upper platen 38.

Figure 8:
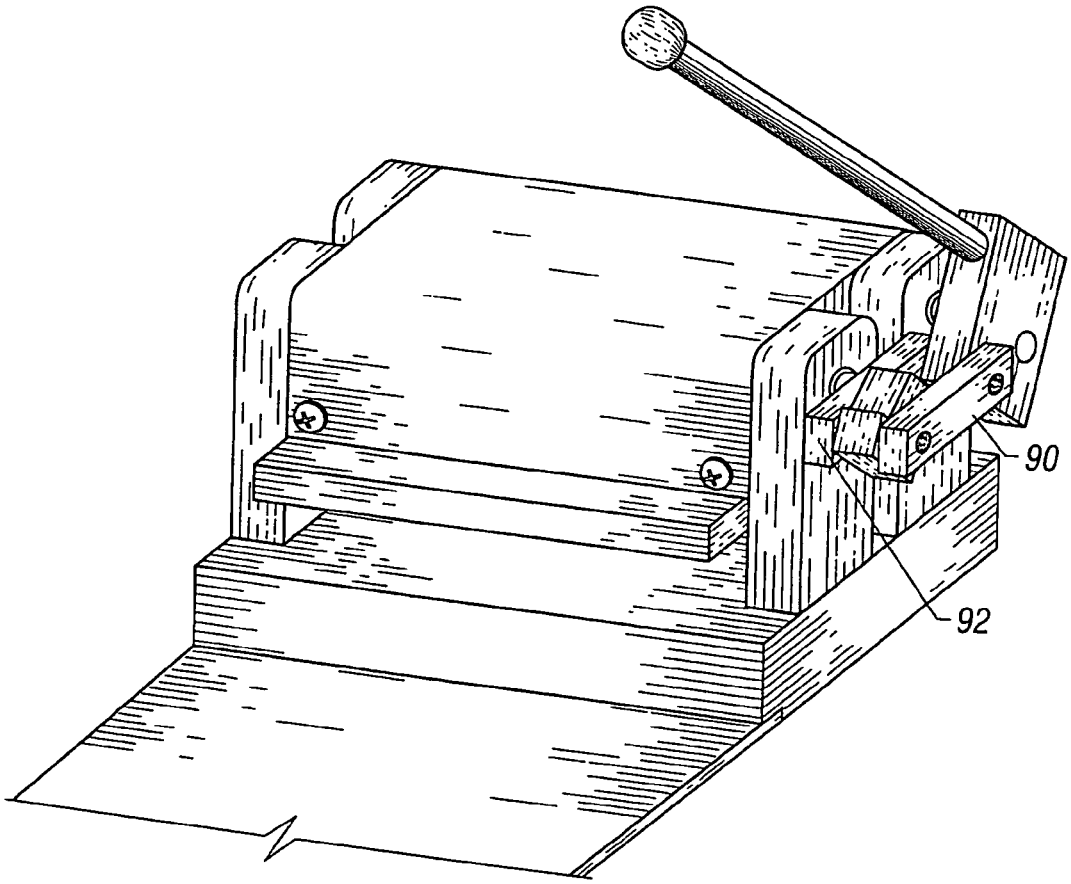
FIG. 8 is a front perspective view of the die press according to an alternative embodiment of the present invention.
Figure 9:
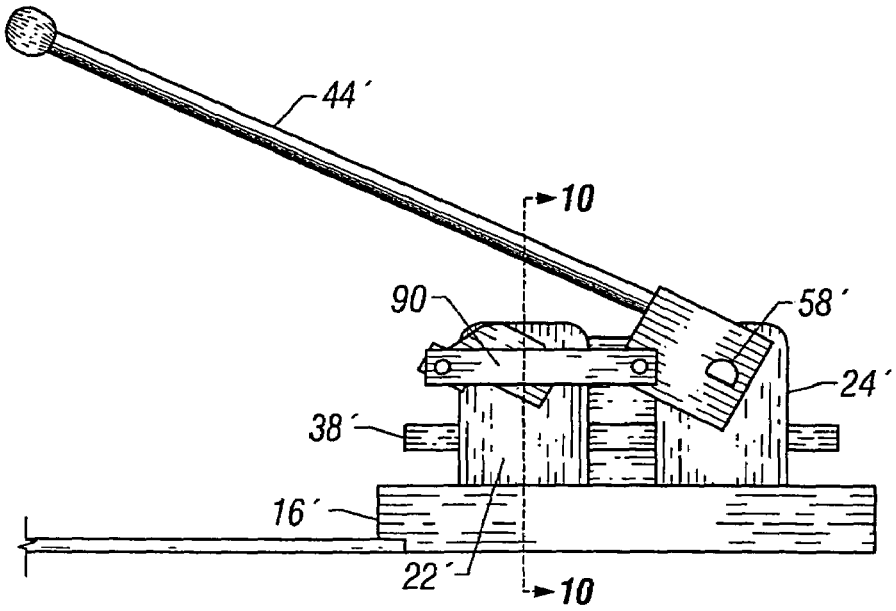
FIG. 9 is a side elevational view of the alternative embodiment of the die press shown in FIG. 8, shown is a closed position.
Figure 10:
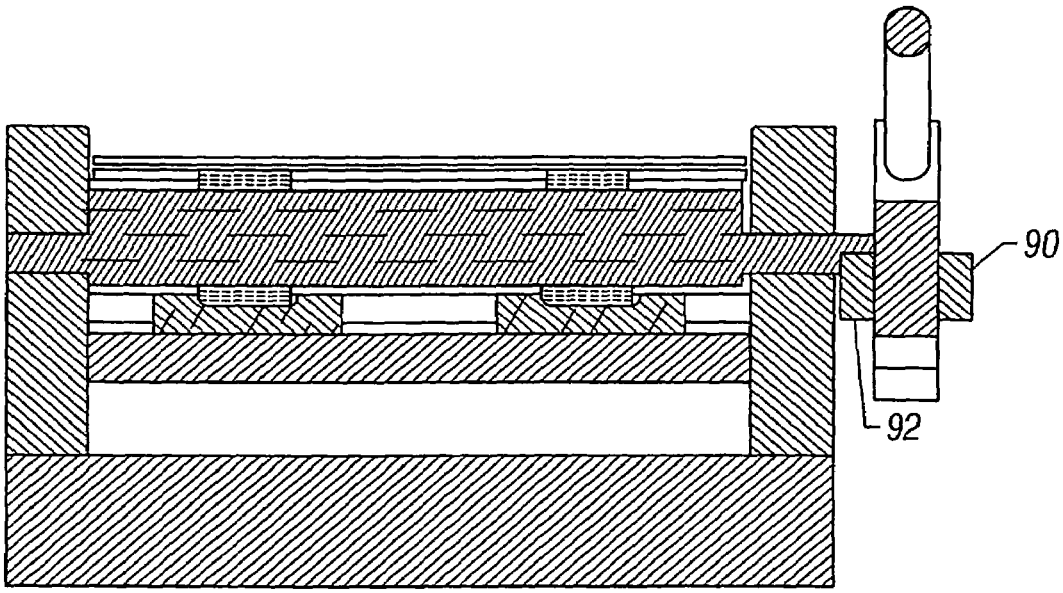
FIG. 10 is a front cross-sectional view similar to FIG. 3A, but showing the alternative embodiment die press shown in FIG. 8.

In yet another alternative embodiment, FIG. 8 illustrates a linkage that sandwiches blocks that extend from the cam members. Linkage components 90 and 92 sandwich a first block that extends from the first cam member and a second block that extends from the second cam member. The handle extends from one of the blocks. FIG. 9 further illustrates the relationship of the components in this embodiment FIG. 10 further illustrates the relationship of linkages 90 and 92 and the blocks that are connected to the cam member ends. This embodiment illustrates that the linkage used to move the cam members in unison may take a variety of configurations. The linkages may be stacked in a vertical configuration as shown in FIG. 1 or they may be aligned in a horizontal configuration as shown in FIG. 8. The intent of the present invention is to illustrate only a few of the configurations that the linkage systems may take and it should be understood by those skilled in the art that the linkage used may take a variety of configurations, yet still fall within the scope of the present invention. For example, the linkage could take the configuration of a gear and rack system, wherein each cam member has located on one end a gear and a gear rack is engaged with each of the cam member gears so that the two cam members move in unison relative to each other when actuated. The gear rack is supported yet free to move so that it engages each of the cam member gears. In this embodiment, the handle may extend from one of the cam members for actuating the cam members, or the handle may extend from one of the gears located on the cam members.

Those skilled in the ant will further appreciate that the cam members do not have to be actuated by a handle. For example, an electronic actuation may actuate the cam members by utilizing a foot peddle or electronic button.

Therefore, disclosed herein is a method for actuating a die press including the steps of rotating at least two cam members generally simultaneously, and applying force to a platen to move the platen toward a base of the die press.

What is claimed is:

1. A die press, comprising:

a base;

at least two cam members spaced from the base;

an upper platen located between the base and the two cam members to define a space for a die, the upper platen being generally parallel to the base;

the upper platen being attached to the two cam members so that when the two cam members are actuated, the upper platen is movable relative to the base;

each cam member having located on one end a gear; and a gear rack that is engaged with each of the cam member gears so that the two cam members move in unison relative to each other when actuated.

2. The die press of claim 1, further comprising:

a handle that extends from one of the cam members for actuating the cam members.

3. The die press of claim 1, further comprising:

a handle that extends from one of the gears located on the cam members.

4. The die press of claim 1, further comprising:

at least two bearings located on each cam member.

5. The die press of claim 4, wherein bearing mounts are located between the bearings and the upper platen.

6. The die press of claim 1, wherein the cam members are actuated by a foot pedal.

* * * * *